US005597044A

United States Patent [19]

Roberts et al.

[11] Patent Number: 5,597,044

[45] Date of Patent: Jan. 28, 1997

[54] METHOD FOR DISPERSING AN ATOMIZED LIQUID STREAM

[75] Inventors: Daryl Roberts, Winchester, Mass.; James R. Butz, Denver, Colo.

[73] Assignee: ADA Technologies, Inc., Englewood, Colo.

[21] Appl. No.: 610,746

[22] Filed: Mar. 4, 1996

Related U.S. Application Data

[63] Continuation of Ser. No. 240,271, May 10, 1994, Pat. No. 5,495,893.

[51] Int. Cl.[6] ..... A62C 35/68

[52] U.S. Cl. ..... 169/46; 169/37; 137/896

[58] Field of Search ..... 169/37, 46; 239/423, 239/594, 499; 137/896, 602; 261/78.2

[56] References Cited

U.S. PATENT DOCUMENTS

| | | | |
|---|---|---|---|
| 4,268,460 | 5/1981 | Boiarski et al. | 261/1 |
| 4,578,102 | 3/1986 | Coleman et al. | 65/114 |
| 4,665,395 | 4/1987 | Cioffi et al. | 239/427 |
| 4,734,451 | 3/1988 | Smith | 524/493 |
| 4,872,511 | 10/1989 | Davis | 169/12 |
| 5,014,790 | 5/1991 | Papavergos | 169/44 |
| 5,205,648 | 4/1993 | Fissenko | 366/178.3 |
| 5,211,336 | 5/1993 | Kaidonis et al. | 239/1 |

FOREIGN PATENT DOCUMENTS

| | | | |
|---|---|---|---|
| 85102403 | 4/1985 | European Pat. Off. | B05B 7/02 |

OTHER PUBLICATIONS

Joseph A. Senecal, et al., "Explosion Supression in Occupied Spaces," *Halon Options Technical Working Conference 1994,* May 3–5, 1994, pp. 79–86.

D. J. Spring et al., "New Applications of Aqueous Agents for Fire Suppression," *Halon Alternatives Technical Working Conference 1993,* May 11–13, 1993, pp. 303–308.

Joseph A. Senecal, "Explosion Protection in Occupied Spaces: The Status of Suppression and Inertion Using Halon & Its Descendants," *Fenwal Safety Systems,* 1993, pp. 767–772.

A. H. Lefebvre, et al., "Spray Characteristics of Aerated–Liquid Pressure Atomizers," *J. Propulsion,* vol. 4, No. 4, Jul.–Aug. 1988, pp. 293–298.

Rolf H. Sabersky, et al., *Fluid Flow A First Course in Fluid Mechanics,* 2nd Ed., pp. 299–303 (1971).

D. J. Spring et al., "Alkali Metal Salt Aerosols as Fire Extinguishants," *Halon Alternatives Technical Conference 1993,* May 11–13, 1993, pp. 413–419.

Charles J. Kibert, et al., "Encapsulated Micron Aerosol Agents (EMAA)," *Halon Alternatives Technical Conference 1993,* May, 1–13, 1993, pp. 421–435.

Bernard Lewis, et al., *Combustion, Flames and Explosions of Gases,* 3rd Ed., Chapter V, "Combustion Waves in Laminer Flow," pp. 215–218 (1987).

James R. Butz, et al., "Application of Fine Water Mists to Fire Suppression," *Halon Alternatives Technical Working Conference 1992,* May 12–14, 1992, pp. 347–357.

Arthur E. Cote, P.E., et al., *Fire Protection Handbook,* 17th Ed., Nov. 1992, pp. 4–42 through 4–67, 5–4 through 13 and 6–184 through 6–201.

*Primary Examiner*—Gary C. Hoge
*Attorney, Agent, or Firm*—Sheridan Ross P.C.

[57] ABSTRACT

One aspect of the present invention discloses a deflagration suppression system, which is particularly applicable to delagrations involving combustible gases. The deflagration suppressant in the system is typically water which is dispersed in the combustible gas as a stream of droplets having a Sauter mean Diameter of no more than about 80 microns. The system can include a combustible substance detector to detect potentially explosive concentrations of a combustible substance, such as the combustible gas, before the onset of a deflagration.

Another aspect of the subject invention discloses a liquid atomizing device which is particularly applicable to the deflagration suppression system. The liquid atomizing device atomizes the liquid in a carrier gas and the liquid droplets are further decreased in size by increasing the velocity of the droplets to a supersonic velocity.

21 Claims, 5 Drawing Sheets

METHOD FOR DISPERSING AN ATOMIZED LIQUID STREAM

This is a continuation of application Ser. No. 08/240,271, filed May 10, 1994, now U.S. Pat. No. 5,495,893.

FIELD OF THE INVENTION

The present invention relates to a system for controlling the deflagration of a combustible substance and in particular to a system for suppressing the deflagration of combustible gases in industrial applications.

BACKGROUND OF THE INVENTION

Combustible gases are handled in many industrial applications, including utilities, chemical and petrochemical manufacturing plants, petroleum refineries, metallurgical industries, distilleries, paint and varnish manufacturing, marine operations, printing, semiconductor manufacturing, pharmaceutical manufacturing, and aerosol can filling operations, as a raw material, product or byproduct. In addition, combustible gases are released by leakage from above- or below-ground piping systems, spillage of flammable liquids, or decomposition of natural organic material in the soil or sanitary land fills.

A combustible gas is any gas or vapor that can deflagrate in response to an ignition source when the combustible gas is present in sufficient concentrations by volume with oxygen. Deflagration is typically caused by the negative heat of formation of the combustible gas. Combustible gases generally deflagrate at concentrations above the lower explosive limit and below the upper explosive limit of the combustible gas.

In a deflagration, the combustion of a combustible gas, or other combustible substance, initiates a chemical reaction that propagates outward by transferring heat and/or free radicals to adjacent molecules of the combustible gas. A free radical is any reactive group of atoms containing unpaired electrons, such as OH, H, and $CH_3$. The transfer of heat and/or free radicals ignites the adjacent molecules. In this manner, the deflagration propagates or expands outward through the combustible gas generally at velocities from about 0.2 ft/sec to about 20 ft/ ec. The heat generated by the deflagration generally causes a rapid pressure increase in confined areas.

To reduce the likelihood that a deflagration will occur, regulations often require deflagration suppression systems in the above-noted applications. Deflagration suppression systems generally include a sensor to detect the occurrence of a deflagration and a device to inject a deflagration suppressant into the combustible gas when a deflagration occurs.

The most widely used deflagration suppressants are saturated chlorofluorocarbons, such as Halon 1301 (bromotrifluoromethane), Halon 2402 (dibromotetrafluoroethane) and Halon 1211 (bromochlorodifluoromethane). The saturated chlorofluorocarbon can be injected into the combustible gas either as a vapor or liquid. Due to the low boiling point and low heat of vaporization of saturated chlorofluorocarbons (e.g., the boiling point is typically no more than about 0° C. and the heat of vaporization no more than about 100 cal/g), liquid chlorofluorocarbons will in most applications immediately vaporize upon injection into the combustible gas.

After injection, the saturated chlorofluorocarbon vapor not only dilutes the oxygen available for the combustion of the combustible gas but also impairs the ability of free radicals to propagate the deflagration. The dilution of the oxygen decreases the concentration of the oxygen available to react with the combustible gas and thereby slows the to propagation rake of the deflagration. The saturated chlorofluorocarbon vapor impairs the ability of free radicals to propagate the deflagration by reacting with the free radicals released in the combustion reaction before the free radicals can react with combustible gas molecules adjacent to the deflagration.

The use of saturated chlorofluorocarbons has recently been curtailed in response to the environmental hazards associated with saturated chlorofluorocarbon emissions. Specifically, saturated chlorofluorocarbon emissions have a high atmospheric ozone depletion potential and are believed to contribute to the depletion of the ozone layer in the earth's upper atmosphere. Several nations have recently enacted legislation restricting the use of saturated chlorofluorocarbons. Additionally, a large number of nations have recently become parties to an international accord to ban the production of saturated chlorofluorocarbons.

In addition to the environmental hazards of saturated chlorofluorocarbons, byproducts of the reaction of saturated and unsaturated chlorofluorocarbons and combustible gas molecules during deflagration can be hazardous for personnel. Specifically, reaction byproducts include hydrochloric acid, hydrofluoric acid, perfluoro-polymers, and carbonyl fluoride, which are known to be toxic.

Another deflagration suppressant is sodium bicarbonate which is injected into the combustible gas as solid particles. To generate and inject the particles, a solid containing the particles, such as a solid explosive composition, is typically combusted. The combustion vaporizes the sodium bicarbonate, which condenses in the ambient atmosphere as a plurality of small particles. The particles suppress the deflagration reaction by absorbing the heat and intercepting the free radicals generated by the deflagration.

Sodium bicarbonate has not been widely used as a deflagration Suppressant since, for most applications, existing delivery systems are generally unable to deliver the particles to the combustible gas in sufficient time to suppress the deflagration reaction at an early stage. To be effective, deflagration suppression systems should deliver the suppressant rapidly to the combustible gas. The solid containing the particles often does not combust at a controlled rate, and is therefore unable to deliver the particles rapidly to the deflagration. Further many delivery systems are unable to disperse the particles uniformly throughout the area containing the combustible gas. Because deflagrations can occur in a variety of locations in a given area and propagate rapidly from the point of ignition, deflagration suppression systems should be able to rapidly and uniformly disperse the particles throughout the area.

SUMMARY OF THE INVENTION

It is an objective of the present invention to provide a system for the suppression of a deflagration with reduced environmental concerns.

It is a further objective to provide a system for the suppression of a deflagration that reduces the attendant risks to personnel.

It is a further objective to provide a system that can rapidly detect a deflagration. A related objective is to provide a system that can rapidly deliver a deflagration suppressant to,the deflagration after detection.

It is a further objective to provide a system that creates reduced risk of a deflagration in an atmosphere containing explosive concentrations of a combustible substance.

It is a further objective to provide a system that can substantially uniformly distribute a deflagration suppressant throughout a defined region containing the combustible substance.

In one aspect of the present invention, it has been discovered that deflagration can be effectively suppressed by heat absorption, and more particularly by utilizing a fine mist liquid stream that can be rapidly vaporized to quickly remove the heat by which a deflagration propagates. One or more of the foregoing objectives are realized by providing a system that includes: (i) a dispersing means positioned within the defined region for dispersing a stream of liquid droplets in the defined region; (ii) a sensing means positioned within the defined region for detecting a predetermined condition within the defined region and generating a signal in response thereto; and (iii) an actuating means connected to the sensing means and dispersing means for actuating the dispersing means in response to the signal received from the sensing means. To effectively suppress the deflagration by heat absorption, it has been discovered that the liquid droplets should have a Sauter Mean Diameter less than about 80 microns. To rapidly disperse the liquid droplets in the defined region, the liquid droplets preferably have a velocity exiting the dispersing means of at least about 10 ft/sec. In this regard, the system preferably is able to disperse the desired concentration of liquid droplets in the defined region within about 100 milliseconds after detection of a predetermined condition.

While the system can be employed to suppress deflagrations associated with combustible gases, solids, and liquids, the system is particularly applicable to suppressing deflagrations of combustible gases having combustion temperatures ranging from about 500 to about 2500° C. Such combustible gases include benzene, ether, methane, ethane, hydrogen, butane, propane, carbon monoxide, heptane, formaldehyde, acetylene, ethylene, hydrazine, acetone, carbon disulfide, ethyl acetate, hexane, methyl alcohol, methyl ethyl ketone, octane, pentane, toluene, xylene, HFC-152, and mixtures thereof.

To be an effective deflagration suppressant, the liquid should have a sufficient boiling point and heat of vaporization to rapidly absorb heat generated by the deflagration. Preferably, the liquid has a boiling point no less than about 50° C. The heat of vaporization of the liquid should be no less than about 500 cal/g. The preferred liquid is water.

The defined region is the designated area to be protected from the effects of a deflagration by the deflagration suppression system. The defined region is typically an enclosed area containing a source for the combustible substance or an area in the enclosed area within which the risk of a deflagration is greatest. The size of the defined region will vary depending upon the application.

In one embodiment of the present invention, the predetermined condition is the concentration of the combustible substance in the defined region. By detecting the concentration of the combustible substance in the defined region, the sensing means is able to detect a condition in the defined region that is conducive to the occurrence of a deflagration before a deflagration actually occurs. The dispersing means is thus able to disperse a stream of liquid droplets in the defined region before the occurrence of a deflagration and thereby reduce the likelihood of a deflagration occurring in the defined region.

In another embodiment of the present invention, the sensing means is at least one of a first sensing means and a second sensing means. The first sensing means includes at least one of the following: a static pressure detector, a rate-of-pressure-rise detector, and an optical flame detector. The second sensing means is a combustible substance detector. To effectively suppress the deflagration, the first and second sensing means should preferably be able to detect a predetermined condition within about 100 milliseconds of the presence of the predetermined condition in the defined region.

In another aspect of the present invention, the dispersing means includes a contacting means for contacting a carrier gas with the liquid to form a fluid comprising the stream of liquid droplets dispersed in the carrier gas. The contacting of the carrier gas with the liquid is preferably effectuated by a porous interface separating the carrier gas and the liquid. A passage containing the liquid is generally located adjacent to the porous interface to disperse the carrier gas in the liquid passing the porous interface.

The carrier gas is preferably selected from the group consisting of nitrogen, carbon dioxide, air, helium, argon, and mixtures thereof. The carrier gas can be generated by combusting a propellant preferably selected from the group consisting of lead azide, sodium azide, and mixtures thereof.

The dispersing means preferably includes a channel having an inlet in communication with the contacting means and an outlet to disperse the stream of liquid droplets in the defined region. The channel has a cross-sectional area normal to the direction of fluid flow that decreases in the direction of fluid flow from the inlet to the outlet to increase the velocity of the fluid. The cross-sectional area of the channel is preferably the lowest at a throat. The cross-sectional area normal to the direction of fluid flow at the throat is preferably less than the cross-sectional area normal to the direction of fluid flow in the passage.

The outlet has a cross-sectional area normal to the direction of fluid flow that preferably increases in the direction of fluid flow from the throat to cause an increase in the fluid velocity from expansion of the carrier gas in the outlet. The fluid pressure in the outlet downstream of the throat is preferably no more than about 53% of the liquid pressure at the throat. Preferably, the expansion of the carrier gas in the outlet will cause the fluid to have a supersonic velocity at a first location along the outlet and a sonic velocity at a second location along the outlet that is downstream of the first location. The transition from supersonic to sonic velocity causes a shock wave that decreases the size of the droplets. The dispersing means as described above is able to produce the liquid droplet size distribution and liquid droplet velocities set forth above in connection with the first aspect of the present invention.

In another aspect of the present invention, the dispersing means preferably includes two coaxial disks forming an inner space between the disks. The inner space contains the channel and outlet with the contacting means being located along the axis of the coaxial disks. The coaxial disks disperse the fluid from a plurality of locations around the periphery of the coaxial disks. In some configurations, the dispersing means can achieve the substantially uniform distribution of the liquid droplets throughout the defined region.

Another aspect of the present invention provides a method for suppressing the deflagration of a combustible substance in a defined region including the following steps: (i) providing a liquid having a heat vaporization no less than about 500 cal/g; (ii) dispersing the liquid in the defined region as a stream of liquid droplets having a Sauter Mean Diameter less than about 80 microns; (iii) transferring the heat generated by the deflagration of the combustible substance to the liquid droplets; (iv) vaporizing the liquid droplets; and (v) maintaining the temperature of the combustible substance located substantially adjacent to the deflagration below the combustion temperature of the combustible substance.

Another aspect of the present invention provides a method for dispensing a stream of liquid droplets including the following steps: (i) providing a liquid stream at a conduit; (ii) providing a carrier gas; (iii) dispersing the carrier gas into the liquid stream as the liquid stream passes through the conduit; (iv) decreasing the velocity of the liquid stream after the dispersing step; (vi) atomizing the liquid stream to form a stream of liquid droplets entrained in the carrier gas; (vii) increasing the velocity of the liquid droplets to a supersonic velocity; (viii) decreasing the velocity of the liquid droplets to a sonic velocity; and (ix) decreasing the average size of the liquid droplets when the liquid droplet velocity decreases from the supersonic to a sonic velocity. Typically, a sonic velocity (e.g., the speed of sound) is about 1100 ft/sec and a supersonic velocity is a velocity greater than a sonic velocity. The method can be employed by the dispersing means described above.

The present invention addresses the above-noted limitations of conventional deflagration suppression systems. In some embodiments of the present invention, the present invention uses water as the liquid. Compared to other deflagration suppressants, water provides not only reduced environmental concerns but also reduces the attendant risks to personnel In other embodiments, the present invention detects a condition conducive to a deflagration before the deflagration occurs. In this embodiment, the sensing means is a combustible substance detector which detects potentially explosive concentrations of a combustible substance before the onset of a deflagration. In contrast, conventional deflagration suppression systems initiate deflagration suppression only after the onset of a deflagration.

Other embodiments provide a system that rapidly disperses the stream of liquid droplets throughout the defined region to suppress the deflagration. The significant velocity of the liquid droplets exiting the dispersing means enables the droplets to be dispersed and the deflagration to be rapidly suppressed. In contrast, some conventional deflagration systems fail to disperse the deflagration suppressant throughout the defined region in sufficient time to prevent an explosion.

Other embodiments of the present invention substantially uniformly distribute the stream of liquid droplets throughout the defined region. The substantially uniform distribution is realized by dispensing the droplets from a variety of locations around the periphery of the dispersing means. In contrast, many existing deflagration systems fail to disperse the deflagration suppressant substantially uniformly throughout the defined region, which reduces the ability of the suppressant to extinguish the deflagration.

These and other advantages are disclosed by the various embodiments of the present invention discussed in detail below.

DETAILED DESCRIPTION

The present invention provides a system for suppressing the deflagration of a combustible substance. The system is capable not only of extinguishing a deflagration at an incipient stage but also of reducing the likelihood of a deflagration occurring in a defined region having a concentration of a combustible substance above the lower explosive limit of the combustible substance.

Figure 1:
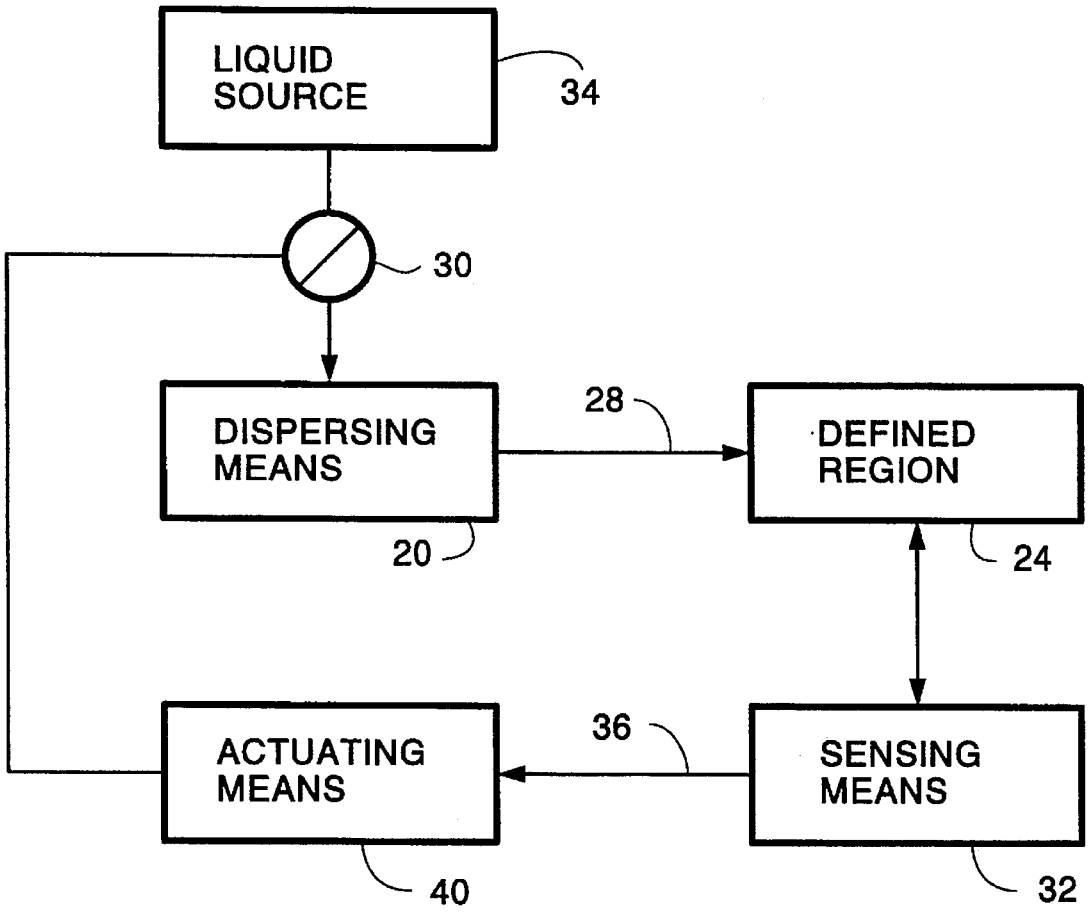
FIG. 1 is a flow schematic illustrating an embodiment of the deflagration suppression system of the present invention.
Figure 5:
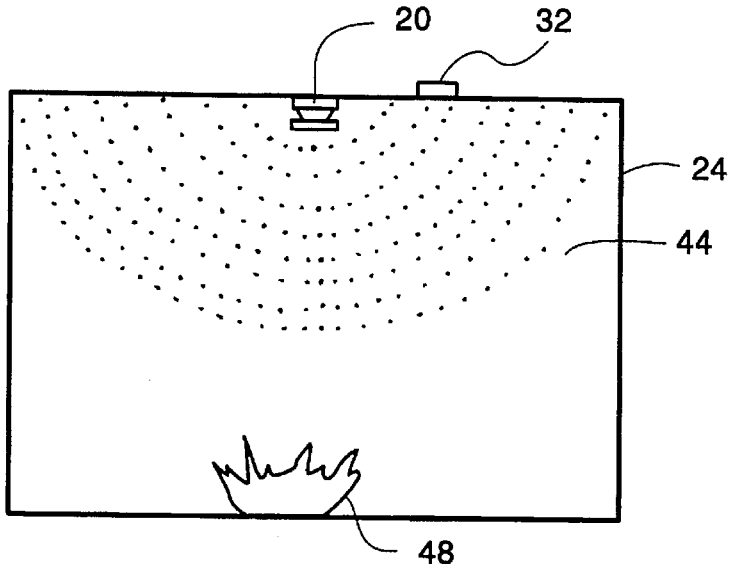
FIG. 5 is a view of an embodiment of the deflagration suppression system illustrated in FIG. 1 applied to the defined region.

Referring to FIG. 1, the deflagration suppression system of the present invention includes dispersing means 20 positioned within the defined region 24 for dispersing a stream 28 of liquid droplets in the defined region 24, sensing means 32 positioned within the defined region 24 to detect a predetermined condition within the defined region 24 and generate a signal 36 in response to such detection, and actuating means 40 connected to the sensing means 32 and dispersing means 20 for actuating the dispersing means 20 in response to the signal 36 received from the sensing means 32.

The predetermined condition is one which would indicate the occurrence of a high risk of a deflagration or the actual occurrence of a deflagration within the defined region 24. The predetermined condition is typically based on one or more of the following parameters: a predetermined static pressure in the defined region 24, a predetermined rate of pressure rise in the defined region 24, the existence of predetermined wavelengths of infrared and ultraviolet emissions in the defined region 24, or a predetermined concentration of the combustible substance in the defined region 24.

Figure 2:
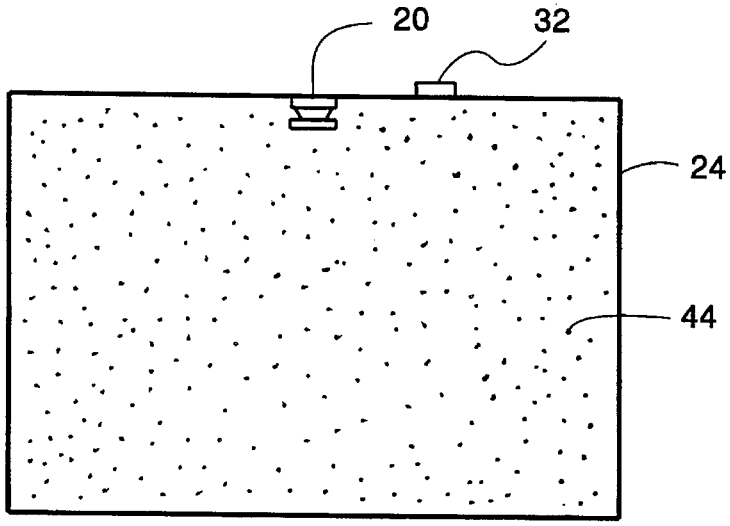
FIG. 2 is a view of an embodiment of the deflagration suppression system illustrated in FIG. 1 applied to the defined region.
Figure 3:
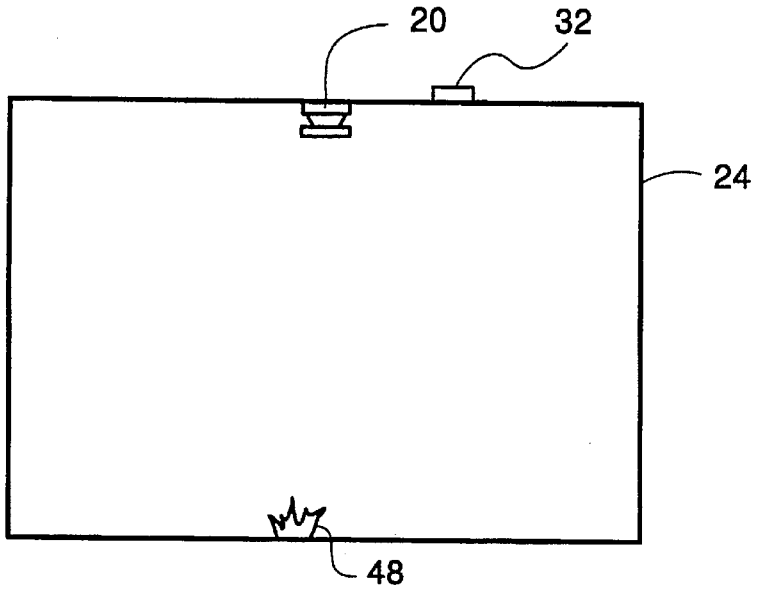
FIG. 3 is a view of an embodiment of the deflagration suppression system illustrated in FIG. 1 positioned in the defined region.
Figure 4:
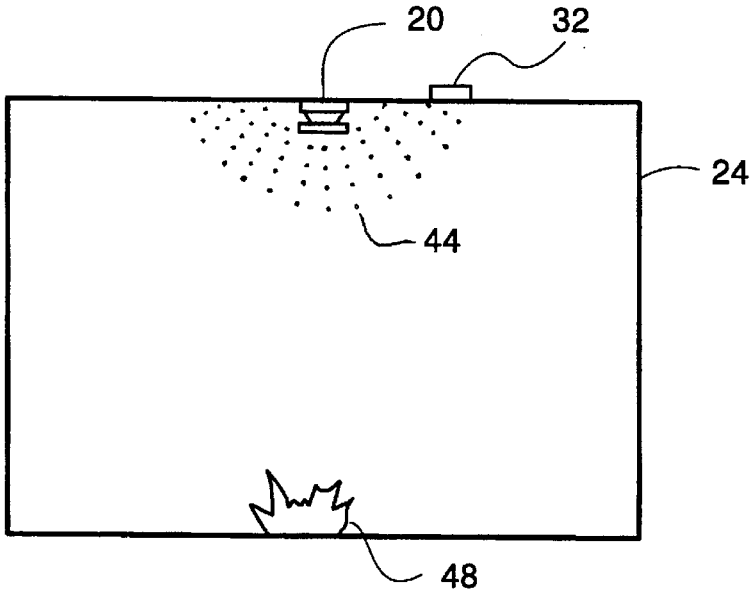
FIG. 4 is a view of an embodiment of the deflagration suppression system illustrated in FIG. 1 applied to the defined region.

Referring to FIG. 2, the dispersing means 20 is typically positioned in the defined region 24 (which is defined in FIG. 2 to be the entirety of an enclosed space) so as to disperse the liquid droplets 44 substantially uniformly throughout such defined region 24. The number and positioning of dispersing means 20 within the defined region 24 will depend upon the size and shape of the defined region 24 and the spread of the liquid droplet stream 28 produced by the dispersing means 20. The dispersing means 20 can be any suitable device for dispersing the liquid droplets in the defined region 24, such as a nozzle or other type of liquid atomizer.

The size distribution and surface area of the liquid droplets 44 are important variables in the suppression of a deflagration. The size distribution and surface area are indicators of the ability of the liquid droplets 44 to suppress the deflagration because the size distribution determines the amount of heat that can be absorbed by the liquid droplets 44 and the surface area determines the rate at which heat is absorbed by the liquid droplets 44. The amount of heat to be absorbed depends upon the expected concentration of the combustible substance within the defined region 24.

Generally, the liquid droplets 44 should have sizes sufficient to vaporize rapidly in response to heat absorption with sufficient mass to be distributed throughout the defined region 24. A variable to express the size distribution of the liquid droplets 44 is the Sauter Mean Diameter. The Sauter Mean Diameter is the total volume of the liquid droplets 44 divided by their total surface area. The Sauter Mean Diameter of the liquid droplets 44 preferably is less than about 80, more preferable less than about 50, and most preferably less than about 30 microns.

The surface area of the liquid droplets 44 in the defined region 24 is a function of the size distribution of the liquid droplets 44 and the concentration of the liquid droplets 44 in the defined region 24 at a selected point in time. In most applications, the peak concentration of liquid droplets 44 in the defined region 24 preferably ranges from about 1.5 gal/1000 $ft^3$ to about 20 gal/1000 $ft^3$, more preferably from about 2 gal/1000 $ft^3$ to about 15 gal/1000 $ft^3$, and most preferably from about 4 gal/1000 $ft^3$ to about 10 gal/1000 $ft^3$.

Eased upon the liquid droplet size distribution and liquid droplet concentration in the defined region 24, the total surface area per unit volume of the liquid droplets 44 in the defined region 24 at the peak liquid droplet concentration preferably at least about 75 $m^2/m^3$, more preferably at least about 100 $m^2/m^3$, and most preferably at least about 150 $m^2/m^3$.

While not wishing to be bound by any theory in this regard, it is believed that the liquid droplets 44 released by the dispersing means 20 in the defined region 24 suppress a deflagration by absorbing the heat released by the deflagration and by diluting the concentration of oxygen in the defined region 24. The absorption of the heat by the liquid droplets 44 decreases the rate of propagation of the deflagration and extinguishes the deflagration when the amount of heat transferred to the molecules of the combustible substance is insufficient to raise the temperature of molecules above their combustion temperature. The propagation rate of the deflagration is controlled by the rate of heat transfer, the combustion temperature of the combustible substance, the amount of combustible substance present in the defined region 24, and the temperature and pressure in the defined region 24. The absorption of heat by the liquid droplets 44 reduces the rate at which heat is transferred to the molecules of the combustible substance. The vaporization of the liquid droplets 44 by heat absorption also decreases the propagation rate of the deflagration by the resulting vapor diluting the oxygen concentration in the defined region 24.

It is further believed that the liquid droplets 44 reduce the likelihood of a deflagration occurring in the defined region 24 by absorbing heat. The liquid droplets 44 are believed to absorb the heat generated by a possible ignition source for a deflagration, such as a spark, or by the combustion of molecules of the combustible substance, before the deflagration is established.

To suppress the deflagration, the liquid droplets 44 must be rapidly dispersed in the defined region 24. Generally, the desired peak concentration of the liquid droplets 44 in the defined region 24 should be realized within about 20 to about 150 milliseconds of detection of a predetermined condition. To reduce the likelihood of an explosion, it is preferred that the deflagration be extinguished within about 50 to about 250 milliseconds after detection of the predetermined condition.

The injection rate and velocity of the liquid droplets 44 exiting the dispersing means 20 are important variables to the ability of the deflagration suppression system to respond rapidly to the predetermined condition. The liquid droplet injection rate per unit volume of the defined region 24 preferably is at least about 1.5 l/sec/$m^3$, more preferably at least about 3 l/sec/$m^3$, and most preferably at least about 5 l/sec/$m^3$. In most applications, the liquid droplet injection rate will preferably range from about 0.5 to about 5 l/sec. The velocity of the liquid droplets 44 exiting the dispersing means 20 preferably ranges from about 100 ft/sec to about 500 ft/sec and more preferably from about 150 ft/sec to 300 ft/sec.

Suitable liquids for the liquid droplets 44 should have a heat of vaporization sufficient to absorb the heat as it is generated by the deflagration. The liquid preferably has a heat of vaporization of at least about 500 cal/g, and more preferably at least about 800 cal/g.

A suitable, liquid should have a sufficient boiling point to remain in the liquid phase until vaporized by heat absorption from the deflagration. The liquid preferably has a boiling point that is no less than about 50° C., more preferably no less than about 80° C. and most preferably no less than about 90° C.

A suitable liquid should have a surface tension sufficient to form the liquid droplets 44. Preferably, the surface tension of the liquid is no more than about 0.006 lbs/ft.

Based on the foregoing factors, a preferred liquid for the deflagration suppression system is water. As will be appreciated, water is cheap, widely available, environmentally acceptable, and nontoxic.

The liquid can include additives to enhance the ability of the liquid droplets 44 to suppress the deflagration, such as free radical interceptors. A preferred free radical interceptor is an alkali metal salt, including potassium bicarbonate, potassium carbonate, sodium bicarbonate, sodium carbonate, and mixtures thereof. The free radical interceptor should have a concentration in the liquid ranging from about 1% up to saturation.

The liquid can include additives to decrease the freezing point of the liquid for applications at low temperatures. As will be appreciated, the freezing point of water is about 0° C., which is above the system temperature in many applications. The liquid can include such freezing-point depressants as glycerine, propylene glycol, diethylene glycol, ethylene glycol, calcium chloride, and mixtures thereof.

The liquid can include additives to alter the surface tension of the liquid droplets 44. For example, wetting agents are effective because they decrease the surface tension of the liquid, thus increasing the amount of free surface available for heat absorption. Suitable wetting agents include surfactants.

The liquid can include additives to decrease friction loss in the dispersing means 20. Linear polymers (polymers that are a single straight-line chemical chain with no branches) are the most effective in reducing turbulent frictional losses. Polyethyleneoxide is the most effective polymer for reducing turbulent frictional losses in the liquid.

To enhance suppression of the deflagration, the liquid droplets 44 should have a temperature exiting the dispersing means 20 that is lower than the temperature of the ambient atmosphere. The rate at which the liquid droplets 44 absorb heat generated by the deflagration is directly related to the temperature difference between the droplet surface and the atmosphere surrounding the droplets 44. The temperature of the liquid drop lets 44 when exiting the dispersing means 20 should range from about 5 to about 30° C.

The sensing means 32 is positioned within the defined region 24 to detect the predetermined condition in the defined region 24. The sensing means 32 should be capable of detecting the predetermined condition in less than about 100 milliseconds.

Because an objective in deflagration suppression systems is to inject deflagration suppressant into the defined region 24 as early as possible in the deflagration, combustible su substance detectors are the preferred sensing means 32 for most applications. A combustible substance detector refer to any device that detects the presence of or measures the concentration of the combustible substance in the defined region. Preferred combustible substance detectors include combustible gas indicators, flammable vapor detectors, combustible gas analyzers, flame-ionization detectors, infrared-type analyzers, and combinations thereof. Unlike other types of detectors, combustible substance detectors do not require a deflagration to occur to generate a signal 36 to the actuating means 40. Rather, combustible gas detectors are able to detect explosive levels of combustible substance in the defined region 24 in advance of a deflagration.

The combustible gas detector typically generates a signal 36 to the actuating means 40 when the concentration of the combustible substance exceeds a specified level that is generally below the lower explosive limit of the combustible substance. Table 1 presents the lower explosive limit (L.E.L.) for a Variety of combustible gases.

TABLE I

| GAS OR VAPOR | L.E.L. % BY VOL. |
|---|---|
| Acetone | 2.5 |
| Acetylene | 2.3 |
| Benzene | 1.4 |
| Carbon Disulfide | 1.0 |
| Carbon Monoxide | 12.5 |
| Ethyl Acetate | 2.2 |
| Ethyl Ether | 1.7 |
| Hexane | 1.2 |
| Hydrogen | 4.0 |
| Methyl Alcohol | 6.7 |
| Methyl Ethyl Ketone | 1.8 |
| Octane | 1.0 |
| Pentane | 1.40 |
| Propane | 2.20 |
| Toluene | 1.3 |
| Xylene | 1.0 |

Other possible sensing means 32 include static pressure detectors, rate-of-pressure-rise detectors, optical flame detectors, and combinations thereof. Static pressure detectors, rate-of-pressure-rise detectors, and combustible substance detectors are generally employed in confined areas. Optical flame detectors and combustible substance detectors are generally employed in open areas.

Static pressure detectors are devices that activate when the static pressure in the defined region 24 is at a specified level. When the pressure exceeds a specified level, typically 0.5 to 1.0 psi, the static pressure detector generates the signal 36 indicating the occurrence of a deflagration.

Rate-of-pressure-rise detectors refer to devices that activate when the rate of pressure rise in the defined region 24 exceeds a specified rate. Rate-of-pressure-rise detectors detect a deflagration based upon the increase in pressure in the defined region 24 from the deflagration. When the pressure increase is above the specified level, the rate-of-pressure-rise detector generates a signal indicating the occurrence of a deflagration. Generally, in confined areas, the pressure will increase rapidly in the event of a deflagration. Rate-of-pressure-rise detectors are typically used in defined regions 24 having operating pressures significantly above or below atmospheric pressure.

An optical flame detector refers to devices that optically detect specified wavelengths of infrared or ultraviolet emissions by the deflagration. Optical flame detectors include infrared flame detectors and ultraviolet flame detectors. Generally, the optical flame detector optically detects either infrared or ultraviolet emissions only within a specified frequency range. The optical flame detector should thus be selected based upon the type of combustible substance in the defined region 24.

Fire detectors normally used in fire suppression systems are generally unsuitable for a deflagration suppression system. Detectors used in fire suppression systems include heat detectors (e.g., fixed temperature detectors and rate-of-rise detectors, smoke detectors (e.g., ionization smoke detectors and photoelectric smoke detectors), and gas-sensing fire detectors which detect the presence of combustion byproducts. As noted above, an important aspect of the present invention is the detection of a deflagration or a condition conducive to a deflagration as early as possible. Detectors for conventional fire suppression systems detect parameters, such as heat, that typically become detectable, if at all, toward the end of the deflagration. Heat is transmitted at a rate dependent on the heat transfer rate. In contrast, the sensing means 32 detects parameters that become detectable within about 100 milliseconds of the initiation of the deflagration. For example, in confined areas, the pressure will increase detectably in the defined region 24 within a few tens of milliseconds of the onset of a deflagration pressure changes are transmitted through a gas typically at a sonic velocity.

As noted above, the deflagration suppression system of the present invention includes actuating means 40 operably connected to the sensing means 32 and dispersing means 20 for actuating the dispersing means 20 in response to the signal 36 from the sensing means 32. The actuating means 40 can be any device capable of actuating the dispersing means 20. Typically, the actuating means 40 is a device, such as a control circuit, that operates a valve 30 to initiate the flow of the liquid to the dispersing means 20 from a liquid source 34. The liquid is typically stored under a pressure of at least about 50, and more preferably at least about 100 psi at the valve 30 to initiate flow to the dispersing means 20 as soon as the valve 30 is opened. The valve 30 is located substantially adjacent to the dispersing means 20.

The operation of the deflagration suppression system of the present invention will now be described. Referring to FIGS. 1 through 5, the sensing means 32 communicates a signal 36 to the actuating means 40 when a predetermined condition is detected in the defined region 24. As noted above, the predetermined condition is representative of an unsafe condition in the defined region 24 that may either be conducive to a deflagration 48 or be a deflagration 48 itself. The actuating means 40 opens the valve 30, causing the liquid source 34 to provide the liquid to the dispersing means 20 in response to the signal 36.

Referring to FIGS. 2 through 5, the stream 28 of liquid droplets 44 moves rapidly towards the deflagration 48 and surrounds the deflagration 48. The liquid droplets 44 in the stream receive heat from the deflagration 48. The liquid droplets 44 increase in temperature from the transferred heat and vaporize; and the resulting vapor dilutes the oxygen concentration in the defined region 24.

As the heat generated by the deflagration 48 is absorbed by the heating and vaporizing of the liquid droplets 44, the rate of combustion of the combustible material adjacent to the deflagration 48 and the propagation rate of the deflagration 48 decrease. When sufficient heat is absorbed by the liquid droplets 44, the temperature of the combustible substance located substantially adjacent to the deflagration 48 is maintained below the combustion temperature of the combustible substance and the deflagration 48 is extinguished.

The present invention further provides a liquid atomizing device that is particularly useful as the dispersing means 20 in the deflagration suppression system. The liquid atomizing device 52, however, is not limited to the suppression of deflagrations. It can be utilized in a variety of application requiring a liquid mist to be dispersed within a defined region. For example, it can be utilized by conventional fire suppression systems to extinguish fires.

Figure 8:
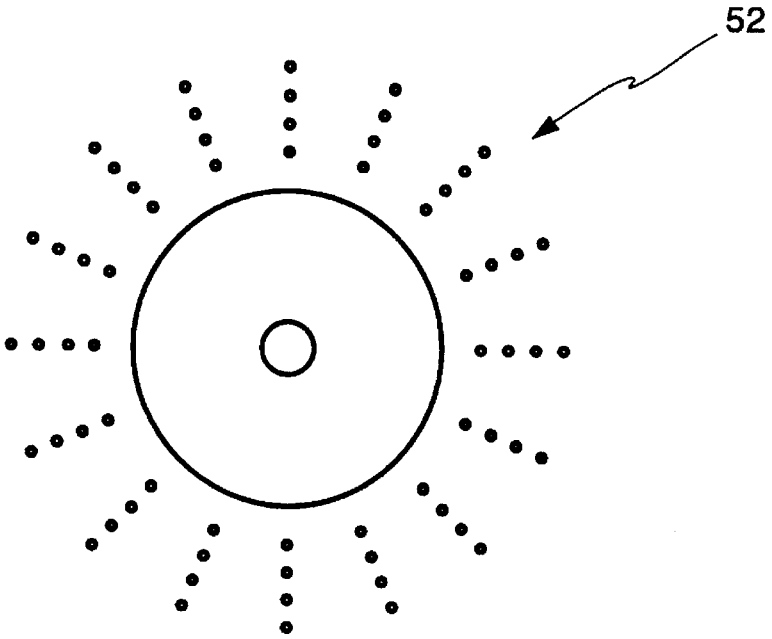
FIG. 8 is a plan view of the embodiment of the liquid atomizing device illustrated in FIG. 6.
Figure 6:
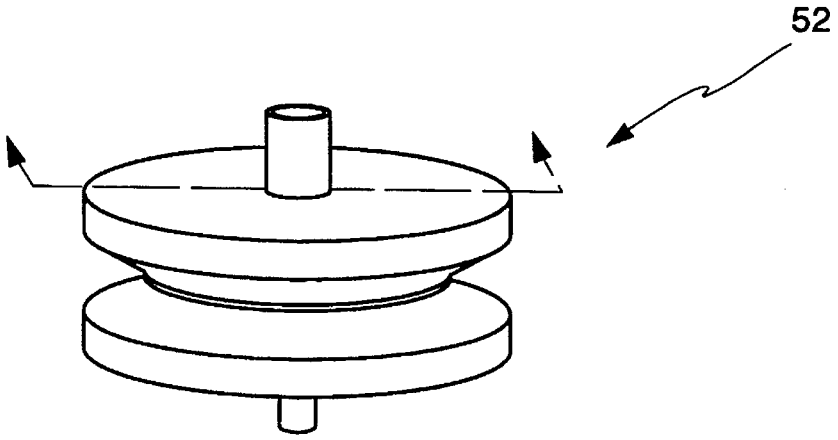
FIG. 6 is a perspective view of an embodiment of the liquid atomizing device.
Figure 7:
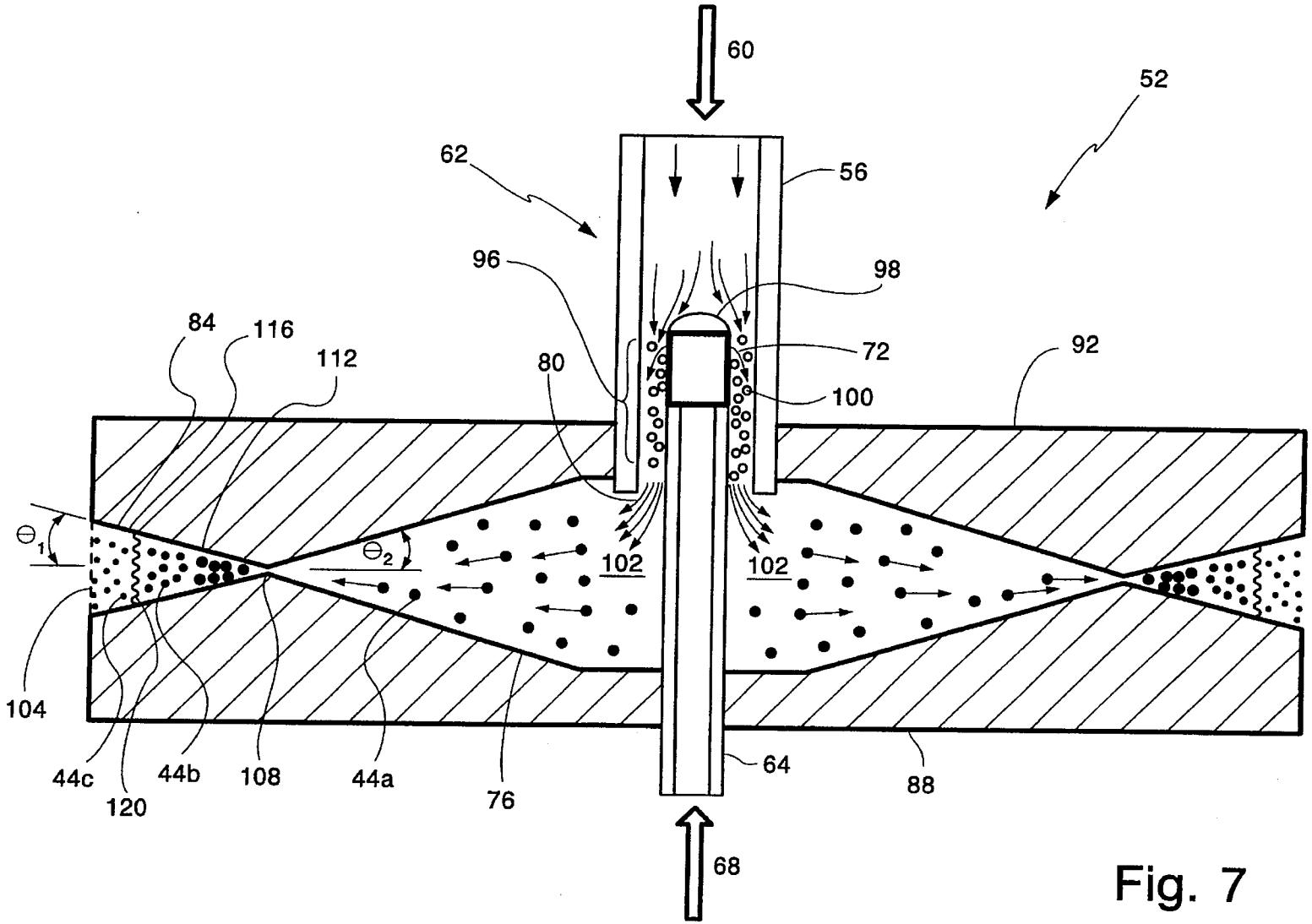
FIG. 7 is a cross-sectional view of the embodiment of the liquid atomizing device illustrated in FIG. 6.

Referring to FIGS. 6 through 8, the liquid atomizing device 52 is illustrated. The liquid atomizing device 52 includes contacting means 62 for contacting a carrier gas 68 with the liquid 60 to form a fluid, and a channel 76 communicating with the contacting means 62 and having an inlet 80, and an outlet 84. The channel 76 is formed in the space between two coaxial disks 88, 92. The contacting means 62 is positioned at the common axis of the two coaxial disks 88, 92 at the inlet 80.

The contacting means 62 includes a first conduit 56 connected to a liquid source (not shown) and a second conduit 64 connected to a carrier gas source (not shown) with the first and second conduits 56, 64 overlapping and forming an annular area 96 between them. The first conduit 56 has a larger diameter than the second conduit 64 and forms the annular area 96 where the second conduit 64 is positioned within the firs conduit 56. The cross-sectional area of the annular area 96 normal to the direction of flow is less than the cross-sectional area of the first conduit 56 normal to the direction of flow upstream of the annular area 96.

The second conduit 64 is connected to the carrier gas source to supply a carrier gas 68 to the liquid 60 to assist formation and delivery of liquid droplets 44. The carrier gas 68 in the carrier gas source can be any gas that is inert relative to the liquid 60 and substantially immiscible in the liquid 60. Suitable carrier gases include nitrogen, carbon dioxide, air, helium, argon, and mixtures thereof.

The carrier gas 68 is typically stored in the carrier gas source under pressure. Preferably, the carrier gas 68 is stored under a pressure ranging from about 200 to about 600 psi as measured at a valve (not shown) substantially adjacent to the liquid atomizing device 52. The carrier gas source can be any suitable container capable of withstanding the storage pressures of the carrier gas 68.

Alternatively, the carrier gas source 68 can be a propellant which is combusted to produce the carrier gas 68. Suitable propellants include lead azide, sodium azide, and mixtures thereof.

The contacting means 62 includes a porous interface 72 on the side of the second conduit 64 in the annular area 96 for contacting the carrier gas 68 with the liquid 60. The porous interface 72 does not extend to the tip 98 of the second conduit 64. Suitable materials for the porous interface 72 include a glass frit, porous metals, porous ceramics, and combinations thereof.

The size of the carrier gas bubbles 100 is inversely related to the velocity of the liquid 60 in the annular area 96 and directly related to the pore size of the porous interface 72. The velocity of the liquid at the porous interface 72 may shear carrier gas bubbles 100 from the porous interface 72, with the shear forces being increased at higher velocities. Preferably, the velocity of the liquid in the annular region 96 is at least about 50 ft/sec. Preferably, the average pore size of the porous interface 72 ranges from about 1 to about 20 microns.

The mass ratio of the liquid 60 and carrier gas 68 in the annular area 96 after the carrier gas 68 combines with the liquid 60 at the porous interface 72 depends upon the desired injection rate into the liquid atomizing device 52 of the liquid 60 and the desired velocity of the liquid droplets 44*c* leaving the outlet 84. Preferably, the mass ratio of the carrier gas 68 to the liquid 60 in the annular area 96 is no more than about 0.25.

The relative pressure of the carrier gas 68 in the second conduit 64 and liquid 60 in the first conduit 56 are important to realize the desired mass ratio in the annular area 96. The carrier gas pressure generally exceeds the liquid pressure. Preferably the liquid pressure is from about 80 to about 90% of the carrier is pressure. The pressure of the liquid 60 at the porous interface 72 should range from about 50 to about 150 psi and the carrier gas 68 from about 70 to about 150 psi.

The fluid passes from the annular area 96 to a mouth portion 102 downstream of the inlet 80. The channel cross-sectional area normal to the direction of flow in the mouth portion 102 is greater than the cross-sectional areas in the first conduit 56 upstream of the annular area 96 and of the annular area 96 itself. While not wishing to be bound by any theory, it is believed that, as a result of the increase in cross-sectional area from the annular area 96 to the mouth portion 102 the carrier gas 68 expands and the liquid forms droplets 44*a* in the carrier gas 68 in the mouth portion 102. In other words, it is believed that in the annular area 96 the liquid 60 is the continuous phase and the carrier gas 68 is the discontinuous phase in the fluid and that in the mouth portion 102, the carrier gas 68 is the continuous phase and the liquid 60 the discontinuous phase in the fluid. As used herein, "continuous phase" refers to the phase constituting at least 75% by volume of the fluid. The fluid in the annular area 96 is preferably from about 20 to about 70% by volume carrier gas and the fluid in the channel 76 is preferably from about 50 to about 95% by volume carrier gas.

The channel 76 has a cross-sectional area normal to the direction of flow that decreases at a predetermined rate in the direction of flow of the fluid from the mouth portion 102 to the outlet 84 to increase the velocity of the fluid. The channel 76 includes a surface having a predetermined shape to decrease the cross-sectional area of the channel 76 and increase in the velocity of the fluid in the channel 76. As shown in FIG. 7, the surface can be sloping at an angle $\Theta_2$, the magnitude of which depends on the diameter of liquid atomizing device 52.

The predetermined rate of decrease in the cross-sectional area is based upon the maximum desired velocity of the fluid in the channel 76. In the channel 76, the fluid preferably has a velocity of no more than about 1000 ft/sec and no less than about 100 ft/sec. To achieve such a velocity, the decrease in cross-sectional area of the channel 76 along the length of the channel 76 is typically at least about 75%.

The lowest cross-sectional area in the channel 76 occurs at a throat 108 at the junction between the channel 76 and the outlet 84. As will be appreciated, the maximum velocity of the fluid in the channel 76 will occur at the throat 108. The fluid pressure at the throat 108 preferably ranges from about 20 psig to about 60 psig. The cross-sectional area of the throat 108 is generally less than the aforementioned cross-sectional areas in the first conduit 56 upstream of the annular area 96 and the annular area 96 itself.

The outlet 84 has a cross-sectional area normal to the direction of flow that increases in the direction of flow of the fluid from the throat 108 to the outlet face 104 to cause an increase in the fluid velocity from expansion of the carrier gas 68 in the outlet 84. The cross-sectional area of the outlet 84 increases at a predetermined rate based upon the maximum desired fluid velocity to be realized in the outlet 84. The velocity increase is caused by a pressure differential between the pressure at the throat 108 and the pressure at the outlet face 104. As will be appreciated, the increase in cross-sectional area along the length of the outlet 84 can be achieved with the angle $\Theta_1$ being zero in some configurations of the liquid atomizing device 52. The cross-sectional area of the outlet 84 in the direction of flow of the fluid depends both on the distance between the two disks 88, 92 and the radial distance from the common axis of the coaxial disks 88, 92.

Preferably, the fluid has a supersonic velocity at a first location 112 along the outlet 84 and a sonic velocity at a second location 116 along the outlet 84 that is downstream of the first location 112, which decreases the size of the liquid droplets 44. The change in velocity from supersonic at the first location 112 and supersonic to sonic at the second location 116, which creates a shock wave 120 in the outlet 84, decrease the size of the liquid droplets 44 due to transition from sonic to supersonic velocity and the pressure discontinuity across the shock wave. In other words, liquid droplets 44*a* have a larger average size than liquid droplets 44*b*, and liquid droplets 44*b* have a larger average size than liquid droplets 44*c*. The decrease in liquid droplet size results from the liquid droplets 44 having a Weber number that is no more than about 1.2. It is generally believed that the liquid droplets 44*c* at the outlet face 104 have an average size that is no more than about 50% of the average size of the liquid droplets 44*a*. The liquid droplets 44*a* preferably have a Sauter Mean Diameter no more than about 160 microns and liquid droplets 44*c* preferably have a Sauter Mean Diameter no more than about 80 microns. The liquid droplets 44*c* preferably have a velocity at the outlet face 104 preferably at least about 200 ft/sec.

To achieve the pressure differential between the pressure at the throat 308 and the outlet face 104, the lowest cross-sectional area in the channel 76 is less than the lowest cross-sectional area in the outlet 84. As a result of the larger cross-sectional area in the outlet 84 compared to the channel 76 the pressure of the fluid at the outlet face 104 will be less than the pressure of the fluid at the throat 108. Preferably to attain sonic and supersonic fluid velocities, the maximum fluid pressure at the outlet face 104 is no more than about 53%, of the fluid pressure at the throat 108.

The distance from the throat 108 to the outlet face 104 should be sufficient to enable the shock wave 120 to occur in the outlet 84. Preferably, the distance from the throat 108 to the outlet face 104 is at least twice the distance from the throat 108 to the point of formation of the shock wave 120.

As shown in FIG. 8 the liquid atomizing device 52 disperses the fluid continuously around its periphery. The dispersion of the liquid droplets 44*c* from a plurality of locations around the periphery of the liquid atomizing device 52 is important to the effective suppression of a deflagration. As noted above, it is often difficult to predict the location of a deflagration in a defined region 24.

The operation of the liquid atomizing device 52 will now be described. Referring to FIGS. 6 through 8, to initiate operation of the liquid atomizing device 52, valves (not shown) are opened in the first and second conduits 56, 64 to provide liquid and carrier gas respectively to the device 52. Alternatively, for a carrier gas source that is a propellant, the propellant is combusted to generate the carrier gas 68.

The liquid 60 passes through the first conduit 56, accelerates as the liquid 60 enters the annular area 96, and contacts the carrier gas 68 at the porous interface 72. The shear force exerted by the liquid on the carrier gas 68 at the porous interface 72 causes carrier gas bubbles 100 to disperse in the liquid 60 to form a fluid.

From the annular area 96, the fluid is injected into the mouth portion 102 of the channel 76, which causes the carrier gas 68 to expand, the fluid velocity to decrease, and the liquid 60 to atomize into liquid droplets 44*a* in the carrier gas 68. As the fluid moves through the channel 76, the cross-sectional area of the channel 76 decreases and the fluid velocity increases to a sonic velocity at the throat 108.

As the fluid passes from the throat 108 into the outlet 84, the carrier gas 68 expands causing the liquid droplets 44*a* to accelerate to supersonic velocity at the first location 112. The transition from sonic to supersonic velocity causes the liquid droplets 44*a* to decrease in size to liquid droplets 44*b*.

As the pressure of the carrier gas 68 approaches the external pressure, the liquid droplets 44*b* decelerate from supersonic velocity to sonic velocity to form the shock wave 120. The shock wave 120 decreases the size of the liquid droplets 44*b* to liquid droplets 44*c*. The liquid droplets 44*c* are dispersed by the outlet 84 into the atmosphere surrounding the device 52 to form a stream of liquid droplets.

EXAMPLE 1

Several tests were conducted to determine the ability of a water mist to extinguish a deflagration. The tests were performed in a steel-walled pressure vessel with a volume of about 6 cubic meters. A spray nozzle array was installed to permit the injection of a water mist into the test vessel. The chamber was also equipped with conventional sprinkler heads with water flow rates appropriately scaled to the chamber volume. The vessel was instrumented with thermocouples and pressure transducers to monitor the pressure history and thermal conditions during the deflagration. Redundant electrical ignition systems were placed in the chamber to initiate the deflagration.

The hydrogen concentration in the test chamber was controlled by measuring the pressure of hydrogen as it flowed into the chamber after evacuation to an absolute pressure of less than 1 millimeter of mercury. The atomizer nozzle air flow was used to assist in the mixing of hydrogen and air in the test chamber, so that a uniform mixture was present at ignition. This was accomplished by backfilling the chamber with air after injection of the hydrogen to a pressure that was below the desired gas pressure at ignition. The additional air needed to bring the pressure of the mixture to one atmosphere was then provided by the atomization air during injection of the water mist by the atomizing nozzles.

In each test, water mist was added to the mixture before ignition. The injection rate of water to the atomizers installed in the chamber was 0.06 liters per second. In the tests, the average size of the liquid droplets in the mist ranged from about 40 to about 60 microns.

In the tests, the deflagration was quenched successfully when between about 2.5 to 12.5 liters of water were injected into the chamber. The concentration of the hydrogen gas during the tests were was approximately 6% by volume.

EXAMPLE 2

Using the test apparatus in Example 1, tests were conducted with standard fire sprinkler nozzles operating in the chamber at a total flow rate of 1.1 liters per second to determine if the sprinkler could quench a deflagration. The concentration of hydrogen gas during the tests was about 6% by volume. The average size of the liquid droplets produced by the sprinkler systems ranged from about 400 to about 800 microns.

The sprinkler systems consistently failed to quench the deflagration. The hydrogen mixture was easily ignited, and the measured pressure profiles were very similar to those from baseline deflagrations conducted in the absence of any deflagration suppressant.

The foregoing tests establish that water mists effectively extinguish deflagrations, while the droplets produced by standard sprinkler systems do not. It is believed that droplets larger than 50 microns do not have sufficient surface area for efficient heat absorption. Larger droplets do not evaporate quickly enough to remove heat at the rate required to prevent propagation of the deflagration. In contrast, droplets having a size less than about 80 microns do have sufficient surface area for heat absorption. Smaller droplets are able to evaporate quickly enough to remove heat at the rate required to prevent propagation of the deflagration.

While various embodiments of the present invention have been described in detail, it is apparent that modifications and adaptation of those embodiments will occur to those skilled in the art. However, it is to be expressly understood that such modifications and adaptations are within the scope of the present invention, as set forth in the following claims.

What is claimed is:

1. A method for dispensing a stream of liquid droplets in a space comprising the steps of providing a liquid stream in a conduit;

providing carrier gas;

dispersing the carrier gas into the liquid stream as the liquid stream passes through the conduit;

decreasing the velocity of the liquid stream after the dispersing step;

atomizing the liquid stream to form a stream of liquid droplets entrained in the carrier gas;

increasing the velocity of the liquid droplets to a supersonic velocity;

decreasing the velocity of the liquid droplets to a sonic velocity;

decreasing the average size of the liquid droplets when the liquid droplet velocity decreases from the supersonic to the sonic velocity; and dispersing the liquid droplets into the space, wherein the Sauter mean Diameter of the liquid droplets in the dispersing step is less than about 80 microns.

2. A method for dispersing a stream of liquid droplets from a nozzle, comprising the steps of:

contacting a liquid stream with a carrier gas stream to form a first fluid stream, wherein the first fluid stream comprises a plurality of carrier gas bubbles entrained in the liquid stream;

forming the first fluid stream into a second fluid stream, wherein the second fluid stream comprises a plurality of liquid droplets entrained in the carrier gas stream;

accelerating the second fluid stream to a supersonic velocity; and dispersing the plurality of liquid droplets from a nozzle.

3. The method of claim 2, wherein the forming step comprises:

increasing the cross-sectional area of a conduit normal to the direction of flow of the second fluid stream.

4. The method of claim 2, wherein the forming step precedes the accelerating step.

5. The method of claim 2, wherein the accelerating step comprises:

decreasing the cross-sectional area of a conduit normal to a direction of fluid flow of the second fluid stream.

6. The method of claim 5, further comprising:

decreasing the velocity of the liquid droplets from the supersonic velocity to a sonic velocity in the conduit by increasing the cross-sectional area of the conduit normal to the direction of fluid flow.

7. The method of claim 6, wherein the average size of the liquid droplets decreases when the liquid droplet velocity decreases from the supersonic to the sonic velocity.

8. The method of claim 7, wherein, after the liquid droplet velocity decreases from supersonic to sonic, the average size of the liquid droplets is no more than about 50% of the average size of the liquid droplets when at supersonic velocity.

9. The method of claim 7, wherein, after the liquid droplet velocity decreases from supersonic to sonic, the Sauter Mean Diameter of the liquid droplets is no more than about 80 microns.

10. The method of claim 7, wherein, before the liquid droplet velocity increases to supersonic, the Sauter Mean Diameter of the liquid droplets is no more than about 160 microns.

11. A method for suppressing an exothermic reaction in a defined region, comprising:

detecting an exothermic reaction in a defined region;

contacting a liquid stream, in response to said detecting of said exothermic reaction, with a carrier gas stream to form a first fluid stream;

forming the first fluid stream into a second fluid stream, the second fluid stream comprising a plurality of liquid droplets entrained in the carrier gas stream;

accelerating the second fluid stream to a supersonic velocity; and dispersing the plurality of liquid droplets from a nozzle into the defined region.

12. The method, as claimed in claim 11, wherein: the exothermic reaction is a combustion reaction.

13. The method, as claimed in claim 11, wherein:

the liquid droplets are dispersed substantially uniformly throughout the defined region.

14. The method, as claimed in claim 11, wherein in the contacting step the carrier gas stream is at a gas pressure and the liquid stream is at a liquid pressure and the gas pressure exceeds the liquid pressure.

15. The method, as claimed in claim 14, wherein the liquid pressure is at least about 80% of the gas pressure.

16. The method, as claimed in claim 14, wherein the liquid pressure ranges from about 50 to about 150 psi and the gas pressure ranges from about 70 to about 150 psi.

17. The method, as claimed in claim 11, wherein in the contacting step the the liquid stream is the continuous phase in the first fluid stream.

18. The method as claimed in claim 11, wherein the liquid droplets have a Weber number that is no more than about 1.2.

19. The system, as claimed in claim 11, wherein in the contacting step the mass ratio of the carrier gas to the liquid is no more than about 0.25.

20. A method for suppressing an exothermic reaction in a defined region, by dispersing a stream of liquid droplets in the defined region, the method comprising the steps of:

introducing, as a liquid stream passes through a conduit, a gas stream into the liquid stream to form a first fluid containing a plurality of gas bubbles suspended in the liquid stream;

converting the first fluid into a second fluid that includes a plurality of liquid droplets suspended in the gas stream;

increasing the velocity of the liquid droplets to a supersonic velocity by decreasing the cross-sectional area of the conduit normal to a direction of second fluid flow;

decreasing the velocity of the liquid droplets from the supersonic velocity to a sonic velocity, wherein the average size of the liquid droplets decreases when the liquid droplet velocity decreases from the supersonic to sonic velocity; and dispersing the liquid droplets into the defined region.

21. The method, as claimed in claim 20, wherein:

during the maintaining step, the concentration of the liquid in the defined region preferably ranges from about 1.5 gal/1000 $ft^3$ to about 20 gal/1000 $ft^3$.

* * * * *